US007021234B1

(12) United States Patent
Belyeu

(10) Patent No.: US 7,021,234 B1
(45) Date of Patent: Apr. 4, 2006

(54) MODULAR KAYAK WITH ELEVATED HULL VOIDS

(76) Inventor: Dan B. Belyeu, 3316 Greens Mill Rd., Spring Hill, TN (US) 37174

( * ) Notice: Subject to any disclaimer, the term of this patent is extended or adjusted under 35 U.S.C. 154(b) by 0 days.

(21) Appl. No.: 11/236,710

(22) Filed: Sep. 27, 2005

Related U.S. Application Data

(60) Provisional application No. 60/613,244, filed on Sep. 27, 2004.

(51) Int. Cl.
*B63B 35/00* (2006.01)

(52) U.S. Cl. ..... 114/347; 114/182

(58) Field of Classification Search ..... 114/182, 114/347
See application file for complete search history.

(56) References Cited

U.S. PATENT DOCUMENTS

| | | | | |
|---|---|---|---|---|
| 1,786,091 | A | 12/1930 | Stiles | |
| 2,712,139 | A | 7/1955 | Kelly | |
| 3,081,726 | A | 3/1963 | Betts | |
| 4,589,365 | A | 5/1986 | Masters | |
| 4,805,549 | A | 2/1989 | Svenning | |
| 5,397,525 | A | 3/1995 | Niemier | |
| 5,417,179 | A | 5/1995 | Niemier | |
| 5,476,055 | A | 12/1995 | Hackett | |
| D400,843 | S * | 11/1998 | Niemier | D12/302 |
| 5,964,177 | A | 10/1999 | Niemier | |
| 6,022,249 | A | 2/2000 | Ketterman | |
| 6,024,042 | A * | 2/2000 | Eilert | 114/355 |
| 6,112,692 | A * | 9/2000 | Lekhtman | 114/347 |
| 6,152,063 | A | 11/2000 | Niemier | |
| 6,178,912 | B1 | 1/2001 | Niemier | |
| 6,220,194 | B1 | 4/2001 | Kjersem | |
| 6,745,716 | B1 | 6/2004 | Belyeu | |

OTHER PUBLICATIONS

MIC Database (US Coast Guard) Hawaii-Yak Inc. J. Turner No Longer in Business, Reference Made Because Models had a Clear Panel in Floor.
Beachcraft Sneaker Boots Http://www.carolinawaterworks.com.
Ocean-Vu Divecon www.wavedancekayaks.com/au Http://www.capacitysports.com.au/sitontops.
Viking Kayaks—Stingray www.vikingkayaks.com.au/glass_bottom_kayaks.htm.

* cited by examiner

*Primary Examiner*—Stephen Avila

(57) ABSTRACT

A sit-on-top kayak hull having an elevated void in the area between the normal seated position of a paddlers legs. The elevated void which is formed into the hull of the watercraft and extends there-through to a height above the normal laden waterline generally to a level of the approximate height of the gunwales forms a hole in the craft which is surrounded by walls. Various modules may be inserted into the hull void for varying needs, such as storage modules, clear modules for underwater vision, or flotation modules. The hull void additionally allows for changes in the running surface of the kayak by insertion of rudders, skegs, center-boards or other devices The void may be left open in full or part for egress of scuba hoses, anchors or other marine devices without affecting the structural integrity of the kayak, its buoyancy, or adversely affecting its performance.

12 Claims, 7 Drawing Sheets

MODULAR KAYAK WITH ELEVATED HULL VOIDS

This application claims the benefit of Provisional Patent Application Ser. No. 60/613,244 Filed Sep. 27, 2004

FEDERALLY SPONSORED RESEARCH

Not Applicable

SEQUENCE LISTING OR PROGRAM

Not Applicable

BACKGROUND

1. Field of Invention

This invention relates generally to improvements in kayak construction, specifically sit-on-top kayaks.

2. Description of Prior Art

Prior to issuance of U.S. Pat. No. 6,745,716 to the present inventor there existed a need for a kayak which provides reconfiguration for varying paddling needs and situations via a modular kayak design. U.S. Pat. No. 6,745,716 teaches of a kayak with central hull voids and removable central hulls. However, the need exists for a self bailing sit-on-top kayak not fully disclosed by the present inventor in U.S. Pat. No. 6,745,716. Reading on the claims of U.S. Pat. No. 6,745,716, one can see that an element of that invention, the removable cockpit is an integral part of the previous invention, and is therefore required to complete the invention in a practical and useful manner. The removable cockpit of U.S. Pat. No. 6,745,716 is eliminated herein via a new design and manufacturing process which allows for a self bailing design of sit-on-top kayak by introducing an elevated centrally located void and having drain holes empty into the void above the waterline within a non-removable cockpit area.

The process of manufacturing rotationally-molded polyethylene sit-on-top kayaks is generally discussed in U.S. Pat. Nos. 5,397,525 5,964,177 6,152,063 and 6,178,912 issued to Timothy A. Niemier. However, Niemier does not allude to or teach of using centrally located central hull voids in a manner to facilitate modular storage and or insertion of modules for changing the running surface of a sit-on-top kayak. Niemier does teach of vertical scupper holes as are common to most sit-on-top kayak designs. Originally used to add stiffness to the upper portion or deck of the sit-on-top kayak separating it from the bottom, thus preventing collapse, and also to allow for water to exit through the scupper holes. Depending upon the amount of weight in the kayak, the top of scupper holes are above or at the waterline, but when over-laden can be below the waterline allowing an inflow of water into the paddler seating area recess. Scuppers are designed as a vertical pipe to be located at the lowest point in the cockpit or foot rest area during normal usage. It has historically been problematic to insure a properly formed scupper via rotational molding due to manner in which the parting line of traditional rotational molds mate within a small area to create the scupper. The interior of the scupper void, where the top and bottom halves of the molds from which they are formed meet, is the most common area of leakage in sit-on-top kayak hulls. There is normally insufficient room for clamps on the mold to insure a tight fit between the mold halves, resulting in mold leaks and possible holes within the seam of the scupper. Due to the increased probability of a leaking parting line within the scupper area, manufacturing costs are increased due to scrap, re-work, and returns of kayaks from customers who found them to leak. Niemier does not teach of a hull void which extends from the bottom of the craft to the proximity of the gunwales, nor does he describe the method by which such a void can be manufactured to allow for use as a thigh brace and storage receptacle, as well as a means by which the running surface of the kayak can be altered. Nor does Niemier teach of a modular design or use of a central hull void into which water from the cockpit can drain centrally and above the normal laden waterline. In U.S. Pat. No. 5,417,179, Niemier teaches of a bracing structure located in the central area of the sit-on-top kayak cockpit which can be removed. He does not teach of an elevated area unitarily formed within the kayak cockpit which can be used as a brace member. Lastly, no prior art has been found which teaches of such or suggests such in combination or in part.

In U.S. Pat. No. 5,476,055 issued to Hackett, et al. Dec. 19, 1995, Hackett teaches of an underwater viewing apparatus inserted within a boardlike craft which allows for water to drain around the viewing apparatus. Hacket does not teach of a centrally located elevated void or of such a void within a cockpit or of a void into which water may drain from a cockpit, but rather a method whereby water may drain around the edges of his viewing device to facilitate viewing. Also, as taught by Hackett, a viewing unit must be in place to define his invention. It is clear that the design and described invention by Hackett was not intended nor did teach of the use of an elevated hull void centrally located within a kayak and elevated within a cockpit or for use in a modular manner, or for use as a central drainage system.

In the ship building industry may be found numerous prior art references of ship hull designs which allow for voids in the center of ships as can be seen in U.S. Pat. No. 6,220,194 issued to Kjersem on Apr. 24, 2001. In his patent, Kjersem describes the use of hull voids for the stabilization of ships and to allow for use as access to the water below confined within the center of the ship.

U.S. Pat. No. 6,022,249 Ketterman describes a novel propulsion means for a kayak whereby a void in the roto-molded hull accommodates a propulsion device. The void is shown to act as a self bailing scupper of a size and shape to accept insertion of a peddle device to propel the kayak. While Ketterman does not teach of the manufacture of a kayak with a void in the hull, his device is dependent upon such to function as described. However Ketterman's device does not teach of a hull void which serves as a receptacle for storage or flotation, nor does it teach of a hull void which extends from the bottom of the craft to the proximity of the gunwales, nor does he describe the method by which such a void can be manufactured to allow for use in a modular fashion or use as an elevated cockpit central drainage system.

Masters teaches of a cockpit drain system whereby water is drained from the lower portion of a kayak seating area through ports in the sides of the kayak in U.S. Pat. No. 4,589,365. Such an arrangement as taught by Masters has proven problematic in low free-board vessels such as canoes and kayak in that it allows as much or more water in as out, due to the low nature of the crafts gunwales and from wave action.

It is not uncommon for kayak dealers as well as manufacturers to supply corks and plugs for insertion into scupper holes to disallow water entry via traditional scuppers. As a standard practice a plug is supplied with each of Ketterman's kayaks as is the practice with most leading kayak manufacturers, which further illustrates the problematic nature of traditional scupping holes in sit-on-top kayaks.

From the foregoing, it should be clear that one primary object of the present invention is to provide an improved self bailing sit-on-top kayaks with central hull voids which allow for modular storage, hull reconfiguration, propulsion means, a new method of bailing a sit-on-top kayak as well elimination of traditional scuppers as a means of stiffening the upper deck, also eliminated is the requirement of a module to be inserted in order for the kayak to provide for seating while remaining self bailing.

Prior art is replete with various boat, canoe and kayak designs and various forms of manufacture and add-ons. In the crowded art, small changes and combinations of existing articles of manufacture can yield unexpected results and improvements to human powered watercraft not obvious when viewed as individual parts and components. The claims contained herein are in no small part a minor change to or reliance upon the prior art of others and are a discovery born of this inventor's previous discoveries and research.

OBJECTS AND ADVANTAGES

It is a particular object of the invention to enhance the safety and enjoyment of paddlesports by providing a kayak whereby a plurality of usages may be obtained by insertion of modules within an elevated void within the hull of a sit-on-top kayak. Another object and great advantage of the present invention is to allow for a more functional bailing system for sit-on-top kayaks. In essence this invention is a method of manufacture of a sit-on-top kayak hull with interior voids allowing for insertion of modules for storage, flotation and or changes to portions of the running surface of the hull which may be accomplished from single or multiple modules which allow for a self bailing design of a sit-on-top kayak by introducing an elevated centrally located void and having drain holes empty into the void above the waterline. Another distinct advantage of the present invention is that the cost of manufacture can be minimized due to less scrap and product return which will be facilitated by the new design and process. The hulls may be formed via traditional rotational molding processes, fiber-composite lay-up methods, blow-molding, injection molding, thermoforming, or vacuum forming.

The commercial success of the kayak described in U.S. Pat. No. 6,745,716 has exposed a need throughout the paddlesports community for more craft to be configured in a modular manner. Additionally, current recommendations from the US Coast Guard indicate future requirements for more rigorous standards applicable to paddle craft flotation. There are increasing demands and concerns that self-bailing, levelized floatation and self-buoyant craft be mandated to the kayaking industry. The present invention provides for methods by which flotation may be incorporated into traditional sit-on-top kayak designs without loss of storage space and without breaching the hollow body while simultaneously providing for alterations to the running surface of the kayak and providing a superior means of self bailing. Also, this invention, while combining many known kayak and ship building practices along with newly invented bailing methods results in improved safety and enhanced functionality of sit-on-top kayaks.

Traditional power boats, sail boats and ships have used hawse pipes or drains at the deck level to allow water to exit the craft above the waterline through the gunwales or over their sides above the waterline, however such a design does not function within a sit-on-top kayak in that it allows as much or more water in as out, due to the low nature of the crafts gunwales and from wave action. By allowing the water to drain into the central hull void, wave action and the laden depth of the craft greatly reduce water intrusion into the cockpit. Additionally when a module is in place within the central hull void, wave action would be forced to travel up the spaces between the module and the central hull void walls before reaching a point of intrusion into the cockpit which is very unlikely when the kayak is in motion or laden. Lastly, having voids present within the interior of the craft allowing for a water column to exists within the confines of the crafts perimeter greatly increase stability and reduces the effects of wave action due to the elasticity of water in a columnar fashion.

SUMMARY

In accordance with the present invention a modular kayak with elevated hull voids is an improved sit-on-top kayak design and manufacture process which allows for water to drain from the cockpit into a central hull void above the normally laden waterline as well as to allow for a space into which may be inserted storage receptacles, propulsion devices, flotation devices, and other items. Additionally, the central hull void may be fitted with devices allowing for changes to the running surface of the kayak without lessening the functionality of the central hull drainage system of storage capabilities.

DRAWINGS

The above and other embodiments of the present invention may be more fully understood from the following detailed description, taken together with the accompanying drawings, wherein similar reference characters refer to similar elements throughout, and in which.

DETAILED DESCRIPTION OF PREFERRED EMBODIMENTS

Figure 1:
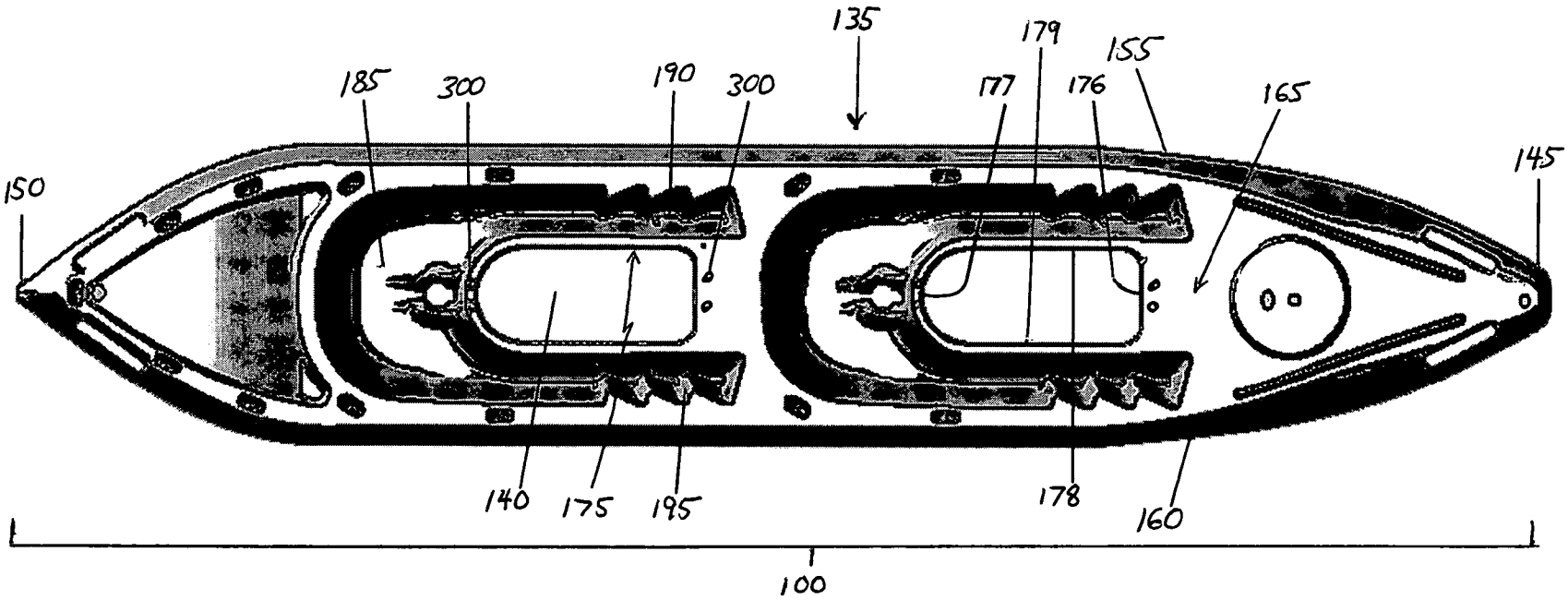
FIG. 1 is a top elevation view of the modular kayak with elevated hull voids.
Figure 2:
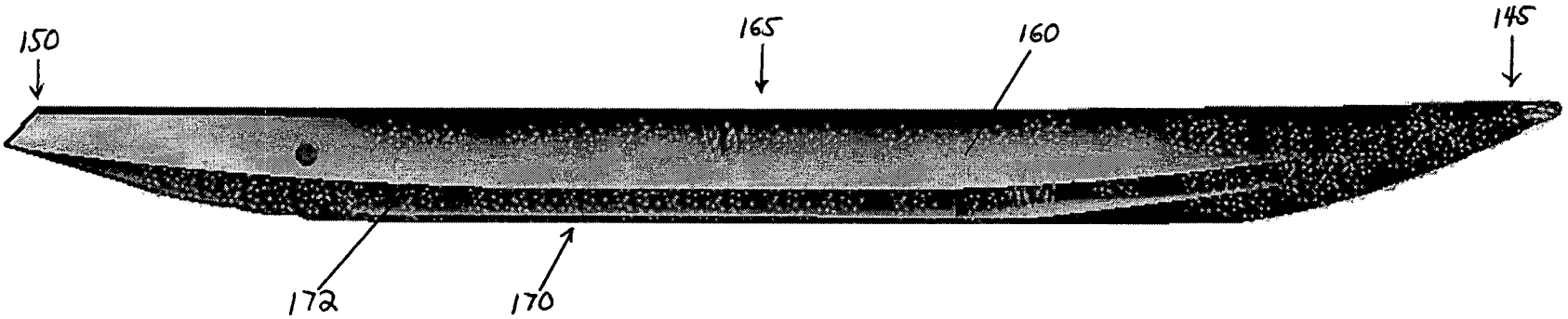
FIG. 2 is a side elevation view of the modular kayak with elevated hull voids.
Figure 3:
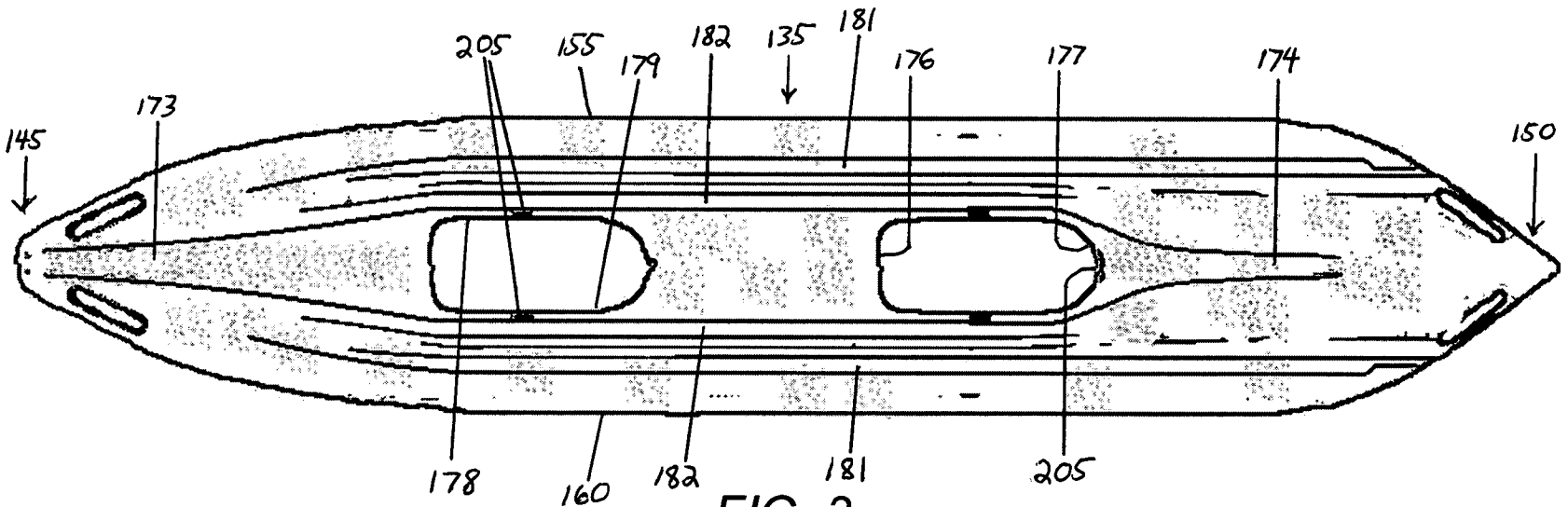
FIG. 3 is a bottom elevation view of the modular kayak with elevated hull voids.
Figure 4:
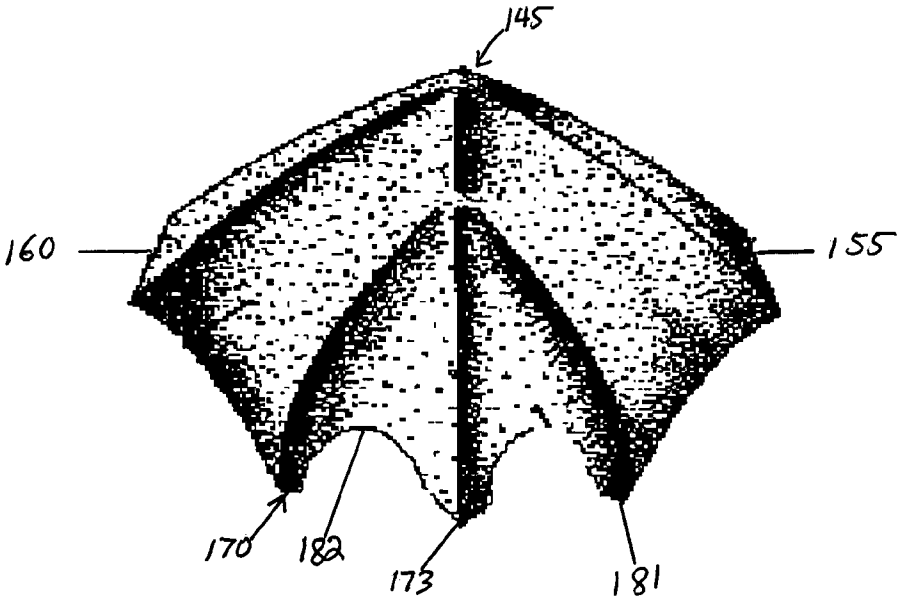
FIG. 4 is a front elevation view of the modular kayak with elevated hull voids.
Figure 5:
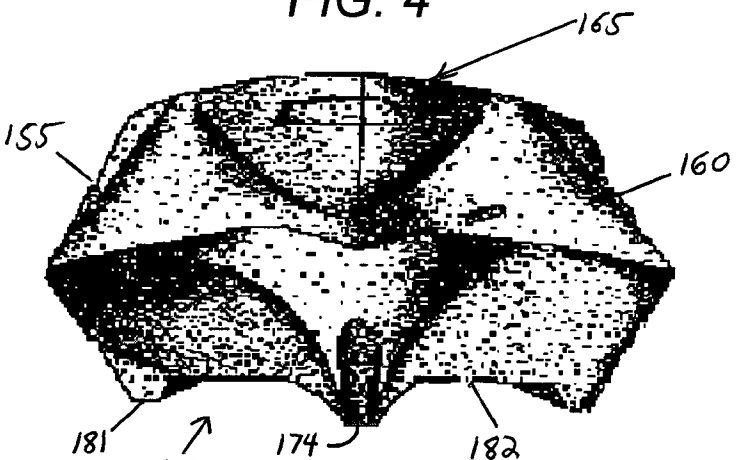
FIG. 5 is a rear elevation view of the modular kayak with elevated hull voids.
Figure 6:
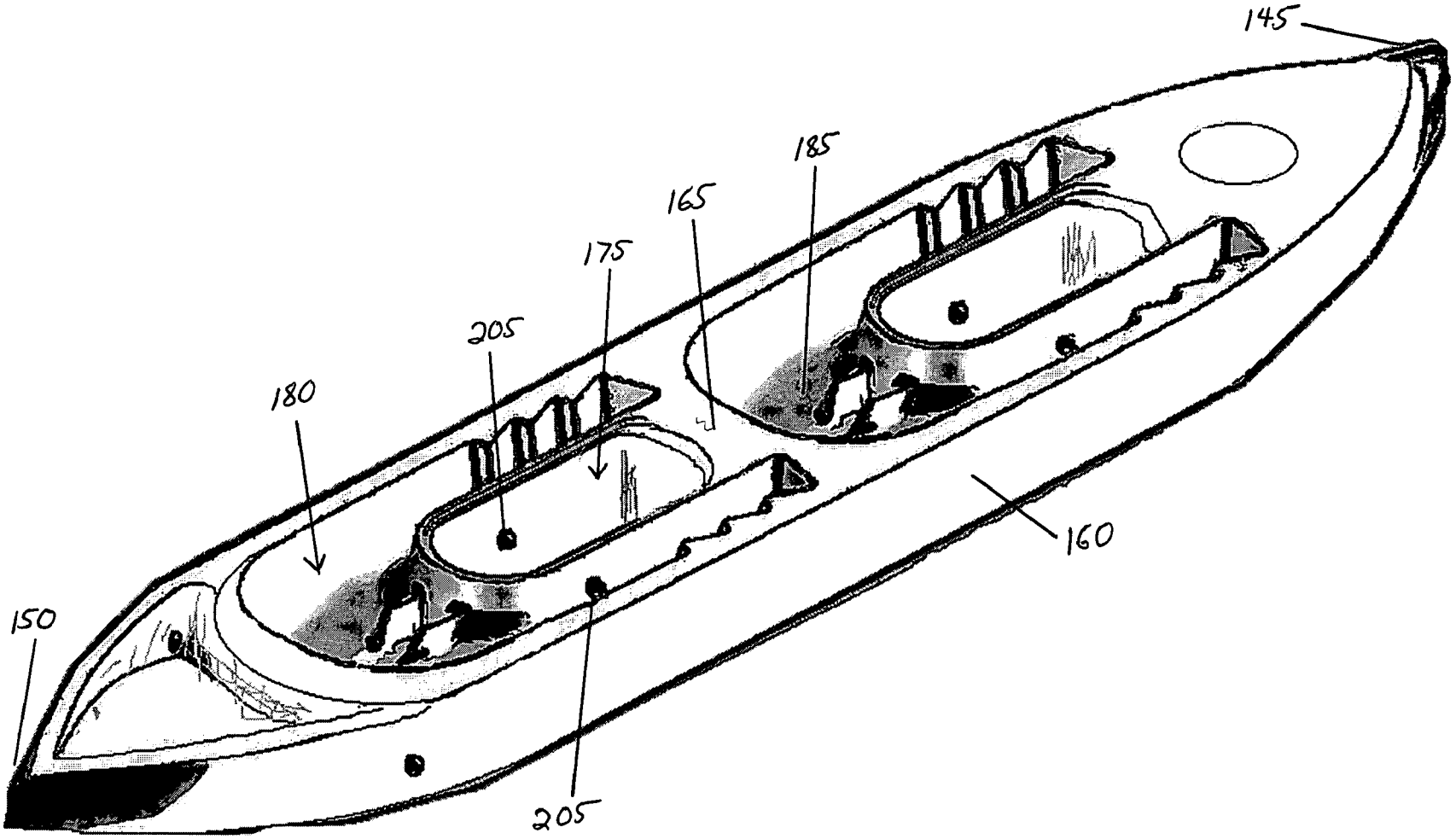
FIG. 6 is an isometric view of the modular kayak with elevated hull voids, taken from an upper side rear end location.
Figure 7:
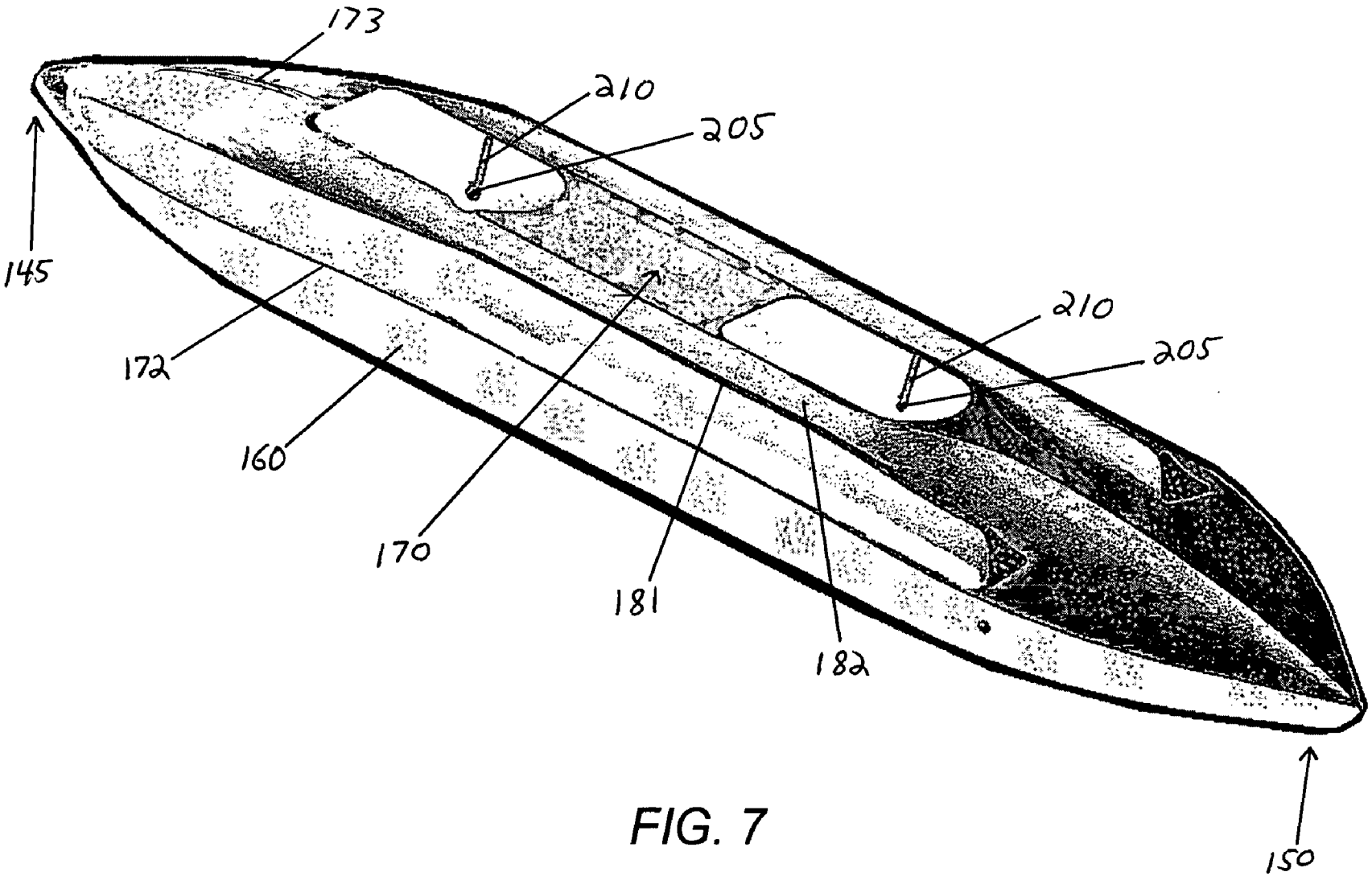
FIG. 7 is an isometric view of the modular kayak with elevated hull voids, taken from an underside position at the rear end location and to one side thereof.
Figure 8:
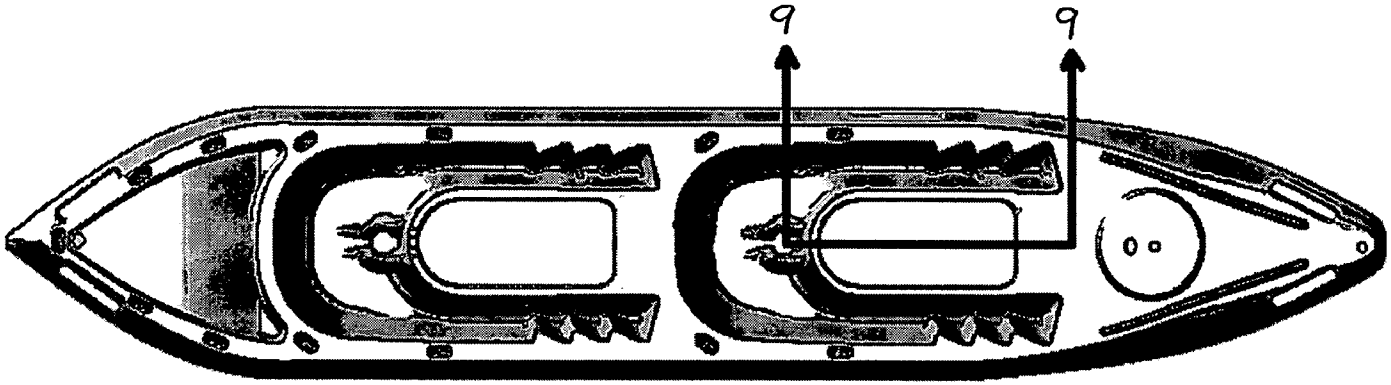
FIG. 8 is a top elevation view of the modular kayak with elevated hull voids referencing the cross section view of FIG. 9.
Figure 9:
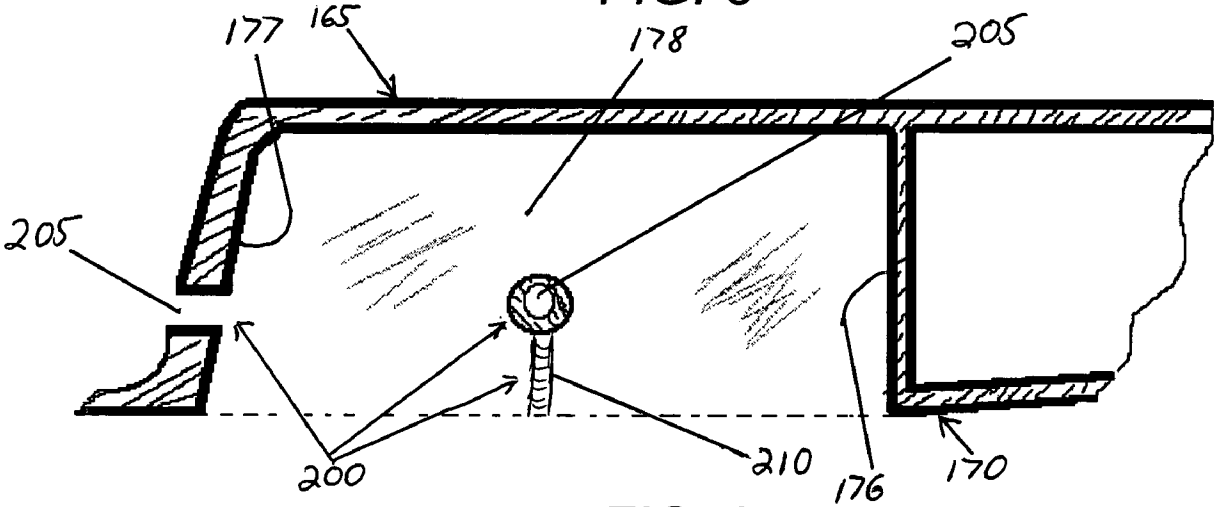
FIG. 9 is a side elevation cross sectional view of the modular kayak with elevated hull voids longitudinally dissecting the interior void.
Figure 10:
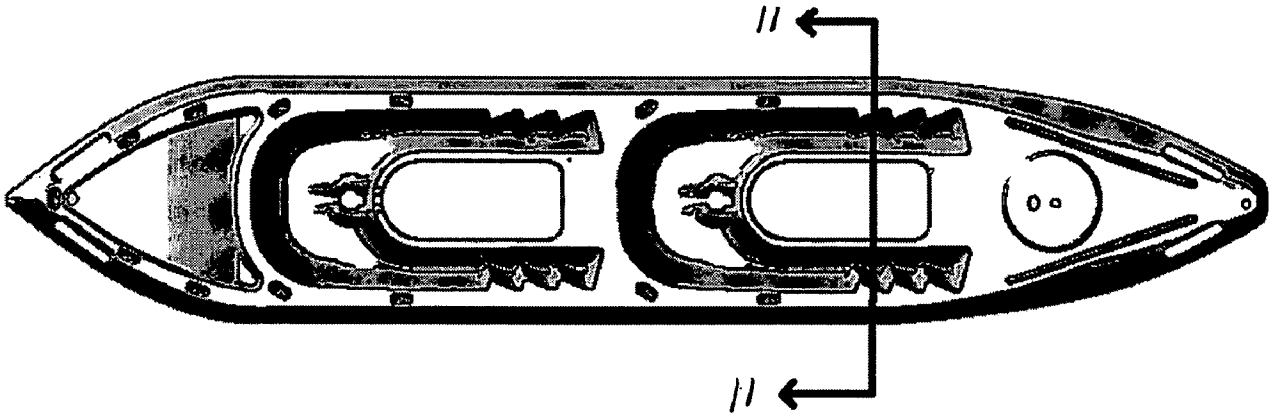
FIG. 10 is a top elevation view of the modular kayak with elevated hull voids referencing the cross section view of FIG. 11.
Figure 11:
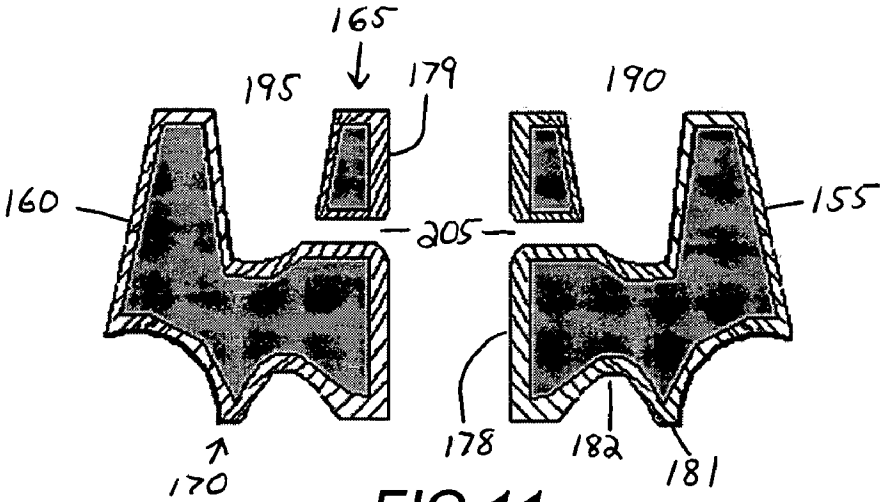
FIG. 11 is a front elevation cross sectional view of the modular kayak with elevated hull voids taken from a positions laterally intersecting the cockpit drains within the footwell areas of the cockpit.

Referring initially to FIGS. 1–3 of the drawings, depicted at 100 is the modular kayak with elevated hull voids, constructed in accordance with, and embodying, the principles of the present invention, The surrounding hull 135 has an outer surface defining a bow end 145 and a stern end 150 and a port side 155 and a starboard side 160 and a top surface 165 and a bottom surface 170 separated by a parting line 172 extending around the perimeter of the surrounding hull 135. The surrounding hull 135 further comprises primary interior walls 175 defining a first end 176 and a second end 177 as well as a first side 178 and a second side 179.

Referring now to FIGS. 1–7 of the drawings, depicted are various views and elements of the modular kayak with elevated hull voids, constructed in accordance with, and embodying, the principles of the present invention.

The cockpit 180 is a recess within the top surface of the surrounding hull 135. The cockpit 180 comprises a seating surface 185, port leg recesses 190, and starboard leg recesses 195. The top of the cockpit is greater in length and width than the bottom of the cockpit 185. The cockpit 180 further comprises an interior void 140 surrounded by seating surface 185 to aft, the port leg recesses 190 to the port, the starboard leg recesses to the starboard, and the top surface 165 forward. The interior void 140, having no top and no bottom is surrounded by the primary interior walls 175. The primary interior walls 175 consist of the first end 176 the second end 177, the first side 178, and the second side 179. Formed within the first side 178 and the second side 179 and the second end 177 are cockpit drains, 205.

The modular kayak with elevated hull voids top surface 165 further comprises recessed receptacles 300, for releasibly attaching cockpits and accessories within the interior void 140.

The modular kayak with elevated hull voids bottom surface 170 further comprises a fore keel 173 and an aft keel 174 to enhance tracking, speed, stability and performance. The fore keel 173 extends in a downward arc from the bow end 145 to a point of intersection with the forward edge of the interior void 140. The aft keel 174 extends in a horizontal plane from the stern end 150 to a point of intersection with the aft edge of the interior void 140.

The bottom surface 170 further comprises a longitudinal planing surfaces 181 which aids in the stability of the kayak as well as allows for straight tracking.

The modular kayak with elevated hull voids bottom surface 170 further comprises flow tunnels 182 which provide a tri-hull stabilizing effect as well as a wave parting function for forward and rear approaching waves as encountered during wave surfing.

Referring now to FIGS. 3–11 shown herein are the details of the interior void 140 and the cockpit drainage system 200 comprising the cockpit drains 205 and interior wall drain recesses 210 and various views showing individual elements thereof. The interior void 140 are defined by the primary interior walls 175 which are comprised of the first end 176, the second end, the first side 178, and the second side 179. The second end 177 containing a cockpit drain 205 which is a bore through the second end 177 through to the seating surface 185. The second end 177 contains a cockpit drain 205. The cockpit drain 205 within the second end 177 is a bore extending through the second end 179 into the lowest point of the seating surface 185 and forms a tube whose bottom bore is at or below the lowest point of the seating surface 185, and is aligned in a horizontal orientation to the top surface 165 of the kayak and is aligned with the longitudinal plane of the kayak. The first side 178 containing a cockpit drain 205 which is a bore through the first side 178 extending through the first side 178 into the lowest point of the port leg recess 190, and is aligned in a horizontal orientation to the top surface 165 of the kayak and is traverse to the longitudinal plane of the kayak. The second side 179 containing a cockpit drain 205 which is a bore through the second side 179 extending through the second side 179 into the lowest point of the starboard leg recess 195, and is aligned in a horizontal orientation to the top surface 165 of the kayak and is traverse to the longitudinal plane of the kayak.

The first side 178 and the second side 179 further comprising interior wall drain recesses 210. The interior wall drain recesses 210 are comprised of grooves of an approximate radius to the bore of the cockpit drains 205 and extend from the cockpit drain 205 in the first side 178 and the second side 179 in a vertical orientation to the longitudinal plane of the kayak to the bottom surface 170. The interior wall drain recesses 210 serve to allow drainage of water from the seating surface 180 and port leg recess 190 and starboard leg recess 195 when there is an object positioned within the interior void 140.

The primary interior walls 175 rise to a height approximately to that of the top surface 165 and provide an elevated area which may be used as a bracing member for the occupant of the kayak. The primary interior walls 175 additionally form the inner-most portions of the port leg recess 190 and the starboard leg recess 195 as well as the forward elevated area of the seating surface 185.

Since certain changes may be made in the above apparatus without departing from the scope of the invention herein involved, it is intended that all matter, including dimension and angles, contained in the above description, as shown in the accompanying drawings, shall be interpreted in an illustrative, and not a limiting sense. Accordingly, the present invention may be embodied in other forms without departing from the scope hereof. All changes that come within the meaning and scope of the claims are intended to be embraced therein.

What is claimed is:

1. A sit-on-top kayak hull with elevated voids comprising:

a hull defining a surrounding hull and interior void, the surrounding hull having a bow end and a stern end longitudinally spaced from the bow end and a port side and a starboard side laterally spaced from the port side and a top surface and a bottom surface vertically spaced from the top surface and primary interior walls extending from said bottom surface to said top surface and longitudinally spaced from said bow end, and longitudinally spaced from said stern end and laterally spaced from said port side and laterally spaced from said starboard side, the interior void having no top and no bottom and surrounded by said primary interior walls, a cockpit defining a seating surface and port and starboard leg recesses, the seating surface being a fossa within said surrounding hull top surface of sufficient depth to be below the top of said primary interior walls and above the normally laden waterline and located aft of said interior void, and laterally centered within said surrounding hull top surface, the port and starboard leg recesses being fossa within said surrounding hull top surface of sufficient depth to be below the top of said primary interior walls and above the normally laden waterline and arranged transversely straddling said interior void and adjacently forward of said seating surface, a cockpit drainage system defining cockpit drains, the cockpit drains traversing through said top surface and said primary interior walls into said interior void, whereby water drains from said cockpit through the cockpit drains afferently into said interior void.

2. The sit-on-top kayak hull with elevated voids of claim 1 wherein said surrounding hull is integrally formed as a single unitary member.

3. The sit-on-top kayak hull with elevated voids of claim 1 wherein said surrounding hull is hollow.

4. The sit-on-top kayak hull with elevated voids of claim 1 wherein said interior void comprises an embrasure open on the top and open on the bottom and vertically surrounded by said primary interior walls.

5. The sit-on-top kayak hull with elevated voids of claim 1 wherein said seating surface includes cockpit drains.

6. The sit-on-top kayak hull with elevated voids of claim 1 wherein said port and starboard leg recesses include cockpit drains.

7. The sit-on-top kayak hull with elevated voids of claim 1 wherein said top surface includes means for releasably attaching items of a size and shape to fit within said interior void.

8. The sit-on-top kayak hull with elevated voids of claim 1 wherein said seating surface and port and starboard leg recesses are of sufficient depth to define the interior void as elevated to a height to be used as a brace member, whereby the operator maintains control of the watercraft by gripping the brace member between an inner side portion of the operator's legs.

9. The sit-on-top kayak hull with elevated voids of claim 1 wherein said cockpit drains are positioned to allow drainage from said cockpit.

10. The sit-on-top kayak hull with elevated voids of claim 1 wherein said cockpit drainage system is of sufficient size to allow for water drainage.

11. The sit-on-top kayak hull with elevated voids of claim 1 wherein said primary interior walls contain interior wall drain recesses defined as depressions traversing upwardly within said primary interior walls whereby said interior wall drain recesses allow for channeling of water when a storage module or other type of module is in place within the interior void and would otherwise restrict water flow.

12. A sit-on-top kayak hull with elevated voids comprising:

a hollow hull integrally formed as a single unitary member defining a surrounding hull and interior void, the surrounding hull having a bow end and a stern end longitudinally spaced from the bow end and a port side and a starboard side laterally spaced from the port side and a top surface and a bottom surface vertically spaced from the top surface and primary interior walls extending from said bottom surface to said top surface and longitudinally spaced from said bow end, and longitudinally spaced from said stern end and laterally spaced from said port side and laterally spaced from said starboard side, the interior void being an embrasure open on the top and open on the bottom and vertically surrounded by said primary interior walls, a cockpit defining a seating surface and port and starboard leg recesses, the seating surface being a depression within said surrounding hull top surface of sufficient depth to be below the top of said primary interior walls and above the normally laden waterline and located aft of said interior void, and laterally centered within said surrounding hull top surface, the port and starboard leg recesses being depressions within said surrounding hull top surface of sufficient depth to be below the top of said primary interior walls and above the normally laden waterline and arranged transversely straddling said interior void and adjacently forward of said seating surface, a cockpit drainage system defining interior wall drain recesses and cockpit drains, the interior wall drain recesses defined as depressions traversing upwardly within said interior walls, the cockpit drains being a bore of sufficient size to allow water drainage from within said cockpit and traversing through said top surface and through said primary interior walls into said interior void, attachment means for releasably attaching items of a size and shape to fit within said interior void, a bracing system wherein said cockpit seating surface and port and starboard leg recesses are of sufficient depth to define the interior void as elevated to a height to be used a brace member, whereby the operator maintains control of the watercraft by gripping the brace member between an inner side portion of each of the operator's legs.

* * * * *